US008500119B2

(12) United States Patent
Hamada et al.

(10) Patent No.: US 8,500,119 B2
(45) Date of Patent: Aug. 6, 2013

(54) SHEET CONVEYING DEVICE AND IMAGE PROCESSING APPARATUS

(75) Inventors: Masataka Hamada, Fuefuki (JP); Kazuhisa Mochizuki, Yamanashi-ken (JP); Tetsuya Noda, Minami-Alps (JP); Seiji Nishizawa, Chuo (JP); Osamu Jinza, Fuefuki (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 1409 days.

(21) Appl. No.: 11/716,726

(22) Filed: Mar. 12, 2007

(65) Prior Publication Data

US 2007/0237430 A1 Oct. 11, 2007

(30) Foreign Application Priority Data

Apr. 10, 2006 (JP) ..... 2006-107499

(51) Int. Cl.
*B65H 9/04* (2006.01)

(52) U.S. Cl.
USPC ..... 271/242; 271/227

(58) Field of Classification Search
USPC ..... 271/242
See application file for complete search history.

(56) References Cited

U.S. PATENT DOCUMENTS

| | | | | |
|---|---|---|---|---|
| 5,720,477 | A * | 2/1998 | Morita et al. | 271/117 |
| 6,098,684 | A * | 8/2000 | Terawaki | 156/353 |
| 7,425,001 | B2 * | 9/2008 | Sano et al. | 271/242 |
| 7,654,522 | B2 * | 2/2010 | Tonami | 271/262 |
| 2001/0042956 | A1 * | 11/2001 | Minoru et al. | 271/265.04 |
| 2005/0140087 | A1 * | 6/2005 | Sano et al. | 271/276 |

FOREIGN PATENT DOCUMENTS

| | | | |
|---|---|---|---|
| JP | 03003844 | A * | 1/1991 |
| JP | U-H05-56851 | | 7/1993 |
| JP | 06072591 | A * | 3/1994 |
| JP | U-H06-49567 | | 12/1994 |

* cited by examiner

*Primary Examiner* — Stefanos Karmis
*Assistant Examiner* — Ernesto Suarez
(74) *Attorney, Agent, or Firm* — Manabu Kanesaka

(57) ABSTRACT

A sheet conveying device includes a conveying path along which a sheet is conveyed. First and second conveying roller pairs are arranged on the conveying path at a predetermined distance from each other. Overlapping conveyance sensing devices are located between the first and second conveying roller pairs and include opposing transmission device and reception device. A distance between the first and second conveying roller pairs is shorter than a length of a minimum size sheet in a conveying direction. In the conveying path between the conveying roller pairs, guide members are disposed to sandwich the transmission device and reception device. The guide members are configured to project upward or downward from a sheet conveying line by a predetermined amount with respect to the conveying path, the sheet conveying line extending through nip points of the first and second conveying roller pairs.

4 Claims, 8 Drawing Sheets

SHEET CONVEYING DEVICE AND IMAGE PROCESSING APPARATUS

BACKGROUND OF THE INVENTION AND RELATED ART STATEMENT

The present invention relates to sheet conveying devices that covey sheets to a predetermined processing position in image forming apparatus such as printers or copiers, image reading apparatus such as scanners, or other sheet handling apparatuses. In particular, the present invention relates to improvements in sheet detecting mechanisms that detect overlapping conveyance of sequentially transferred sheets.

Sheet feeding and conveying devices generally need to detect a sheet being conveyed. Sheet feeding devices separately feed sheets stacked on a sheet feeding tray to a processing position, and the sheet conveying devices convey sequentially delivered sheets downstream to a processing position. In connection with sheet detection, sheet sensors and overlapping conveyance detecting sensors are known.

The sheet sensors detect the presence or absence of a sheet or its passage, and the overlapping conveyance detecting sensors detect overlapping conveyance of sheets, for example, double feeding. In connection with the overlapping conveyance sensor, ultrasonic sensors have been used as relatively simple sensor means. For example, Japanese Utility Model Publication No. 6-49567 proposes a method in which a transmission element (ultrasonic transmitter) and a reception element (ultrasonic receiver) are arranged opposite each other across a sheet so that an ultrasonic wave transmitted by the transmission element can be received by the reception element. Accordingly, the presence or absence of a sheet, or the number of sheets, can be determined on the basis of attenuation of the energy of the ultrasonic wave received by the ultrasonic receiver.

When the transmission and reception elements are arranged opposite to each other across a sheet to detect the presence and number of sheets on the basis of attenuation of an ultrasonic wave passing over the sheets, the ultrasonic wave reflected by the sheet may cause misdetections. This erroneous detection has a disadvantage of stopping the apparatus even though sheets are conveyed normally without overlapping.

Thus, Japanese Utility Model Publication No. 6-49567 proposes that the transmission element and reception element be inclined from the sheet through a predetermined angle to prevent the above problem. Further, in accordance with Japanese Utility Model Publication No. 5-56851, the sheet is held by two belts spaced from each other across the sheet width so that an ultrasonic sensor placed between the belts can detect overlapping conveyance. The invention described in this document prevents sheets from floating as a result of flapping, thereby preventing misdetections.

If overlapping sheets are detected during movement through a conveyance path on the basis of physical attenuation of a sound wave passing over the sheet or the quantity of light (hereinafter referred to as a sound wave), a transmitted wave from the transmission element is reflected by the sheet surface and may return to the transmission element. The returned wave may then interfere with a transmitted wave to cause a misdetection. As disclosed in Japanese Utility Model Publication No. 6-49567, the transmission element and reception element are known to be in a position inclined from the sheet in the path, in order to prevent a reflected wave from interfering with a transmitted wave. However, a locally warped sheet, such as the one shown in FIG. 7, may cause interference between a transmitted wave and a reflected wave, resulting in a similar misdetection. Thus, to prevent such sheet floating or warpage, a method of detecting a sheet bound by a belt is employed, as disclosed in Japanese Utility Model Publication No. 5-56851.

However, in a situation wherein sheets being separably fed along a conveying path are bent for registration, the sheets cannot be bound by a belt, or similar structure. In this case, for example, as shown in FIG. 8, sensor means may be located along side of an upstream sheet conveying roller in the width direction. In the illustrated detecting structure, the sensor is located alongside of the upstream roller and outside a shaded area in which the sheet is likely to be warped. However, this structure poses new problems: with sheets of a smaller width, overlapping conveyance cannot be detected, and with thin sheets with a weight of, for example, 50 grams, the sheets may be curled causing misdetections.

An object of the present invention is to provide a sheet conveying device that can stably and accurately detect overlapping conveyance using overlapping conveyance sensing means such as an ultrasonic sensor when sheets are conveyed by conveying roller pairs located forward and backward in a conveying direction.

Another object of the present invention is to provide a sheet feeding device that can accurately detect overlapping conveyance of sheets when the sheets are separably fed from a stacker to a predetermined processing position, as well as an image processing apparatus.

Further objects and advantages of the invention will be apparent from the following description of the invention.

SUMMARY OF THE INVENTION

The present invention uses a configuration described below in order to accomplish the above objects. A first conveying roller pair and a second conveying roller pair are arranged on a conveying path along which a sheet is conveyed, with at a predetermined distance between the first and second conveying roller pairs. Overlapping conveyance sensing means is placed between the first and second conveying roller pairs. The overlapping conveyance sensing means comprises transmission means and reception means arranged opposite each other across the conveying path. The distance between the first and second conveying roller pairs is shorter than the length of a minimum size sheet in a conveying direction.

The conveying path between the first and second conveying roller pairs have guide members disposed on an upstream side and a downstream side of the conveying path so as to sandwich the transmission means and reception means between the guide members. The guide members guide sheets and are located so as to project upward or downward from a sheet conveying line by a predetermined amount with respect to the conveying path.

The sheet conveying line extends through nip points of the first and second conveying roller pairs. This allows the sheet between the first and second conveying rollers to be pulled and conveyed flat by the upstream and downstream guide members. Consequently, a sound wave, a light beam, or the like emitted by the transmission means is always projected in a fixed angular direction, enabling accurate detections.

The guide members comprise, for example, guide rollers that are rotated in conjunction with movement of a sheet. This reduces a possible load on the sheet. Furthermore, the guide members comprise elongate rollers with a predetermined length in a sheet width direction (the guide members comprise rollers having a cylindrical outer periphery without any step). This enables the sheet to be conveyed and guided flatter, allowing more accurate detections.

Further, a sheet feeding device in accordance with the present invention comprises a sheet feeding tray that accommodates stacked sheets, a sheet feeding roller that separably feeds the sheets from the sheet feeding tray, a first conveying roller pair and a second conveying roller pair arranged downstream of the sheet feeding roller, and overlapping conveyance sensing means placed between the first and second conveying roller pairs.

The overlapping conveyance sensing means comprises transmission means and reception means arranged between the first and second conveying roller pairs and opposite each other across the conveying path. The distance between the first and second conveying roller pairs is shorter than the length of a minimum size sheet in a conveying direction. The conveying path between the first and second conveying roller pairs have guide members disposed on an upstream side and a downstream side of the conveying path so as to sandwich the transmission means and reception means between the guide members.

The guide members are operable to guide a sheet and are located so as to project upward or downward from a sheet conveying line by a predetermined amount with respect to the conveying path. The sheet conveying line extends through nip points of the first and second conveying roller pairs. This allows overlapping sheets to be correctly detected during a process of separably feeding sheets from the sheet feeding tray.

Further, an image processing apparatus in accordance with the present invention comprises, for example, a platen that reads an image, sheet processing means located in the platen to execute sheet processing such as image reading, and a sheet feeding device configured as described above to feed a sheet to the platen.

DETAILED DESCRIPTION OF PREFERRED EMBODIMENTS

A detailed description is described below of a sheet conveying device in accordance with the present invention and a sheet feeding device comprising the sheet conveying device.

Figure 1:
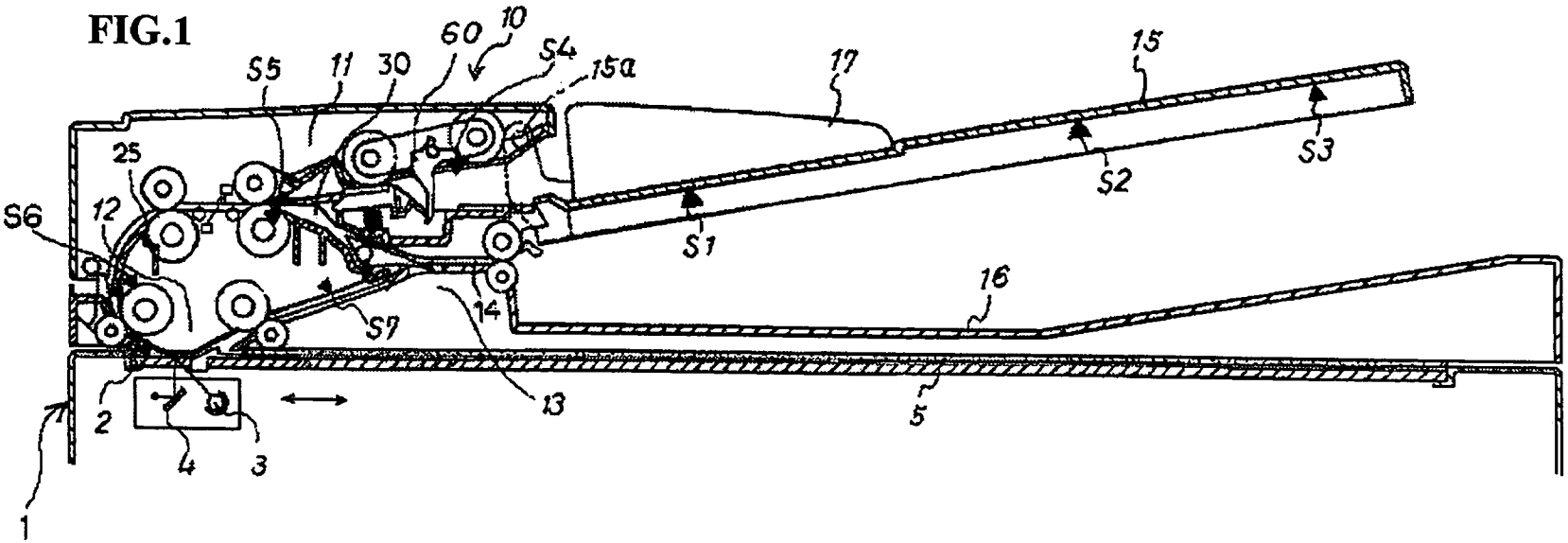
FIG. 1 is a diagram generally illustrating a sheet conveying device in accordance with an embodiment of the present invention and an image reading apparatus comprising the sheet conveying device.
Figure 2:
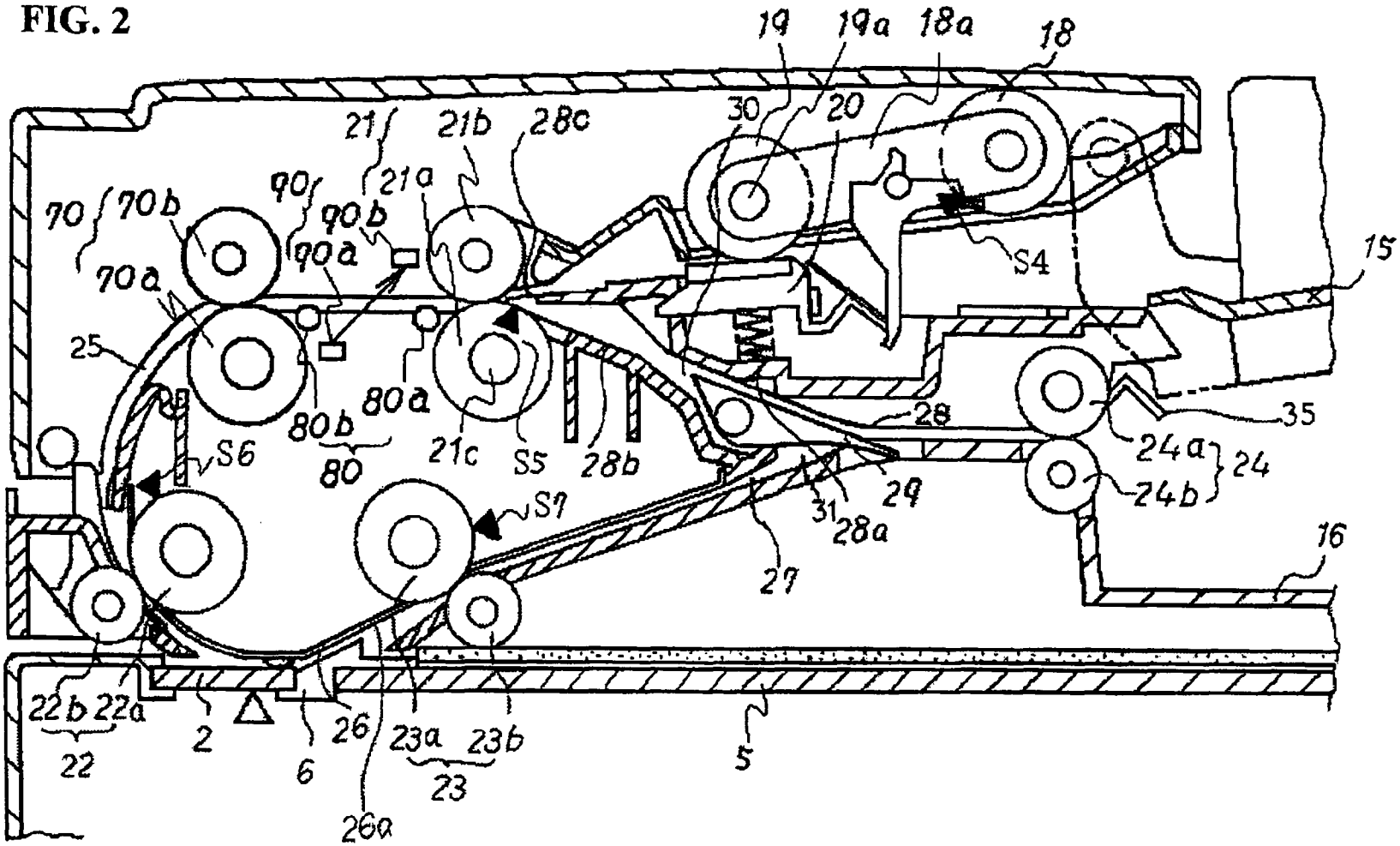
FIG. 2 is an enlarged sectional view of an essential part of the sheet conveying device shown in FIG. 1.
Figure 3:
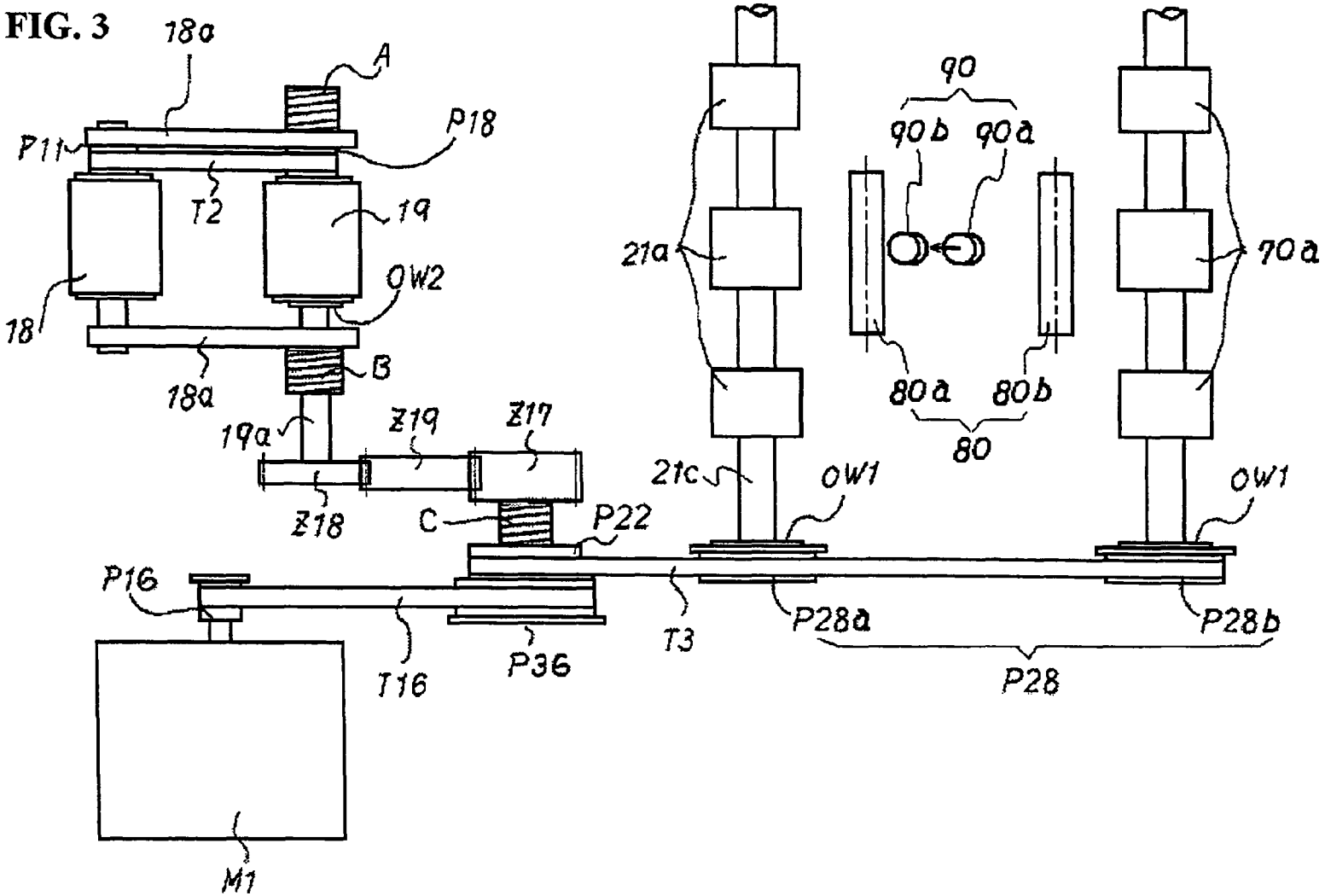
FIG. 3 is a diagram illustrating a sheet feeding driving mechanism in the sheet conveying device shown in FIG. 1.

FIG. 1 is a diagram of configuration of a sheet conveying device incorporated into an image reading apparatus (image processing apparatus) such as a scanner or a copier. FIG. 2 is a diagram illustrating an essential part of a sheet feeding section of the sheet conveying device. FIG. 3 is a diagram illustrating a driving mechanism in the device in FIG. 2. First, the configuration of the image reading apparatus (image processing apparatus) will be described with reference to FIGS. 1 and 2. Subsequently, a sheet conveying device in accordance with the present invention will be described.

In FIG. 1, reference numeral 10 denotes a sheet conveying device (hereinafter referred to as an "ADF") mounted in an image reading apparatus, or an image processing apparatus, such as the image reading apparatus 1 described below. The ADF 10 includes a U-shaped conveying path along which a sheet is conveyed so as to pass over a top surface of a first platen 2 provided in the image reading apparatus 1.

The image reading apparatus 1 has a light source such as a lamp that is located below the first platen 2, a mirror 4 that polarizes reflected light resulting from irradiation of a sheet with light from the light source 3, and optical reading means (not shown), such as a CCD sensor (charge coupled device) which electrically reads an image from the sheet.

The image reading apparatus 1 has a reading section provided on the top surface of the first platen 2. The image reading apparatus 1 includes a second platen 5 on which a sheet is stationally set. The ADF 10, located above the second platen 5, is opened, and a light source unit (carriage) composed of the light source 3, the mirror 4, and the like, is moved in a sub-scanning direction to read a sheet image from a book document or other sheets set on the second platen 5.

The ADF 10 includes a sheet feeding tray 15 on which a plurality of sheets are placed, a sheet feeding section (sheet feeding means) 11 that separably feeds each of the sheets on the sheet feeding tray 15 toward the first platen 2, a conveying section (conveying means) 12 that passes the sheet along the top surface of the first platen 2 at a predetermined speed, a sheet discharging section (sheet discharging means) 13 that receives and discharges the sheet having passed over the top surface of the first platen 2, and a sheet discharging tray 16 that houses the sheet from the sheet discharging section 13. The ADF 10 further includes a switchback section 14 that allows the sheet discharging section 13 to switch back the sheet carried out from the first platen 2 to transfer the sheet back to the sheet feeding section 11 so that the first platen 2 can read a back surface of the sheet. The ADF 10 further includes a circulating path 30.

The sheet feeding tray 15 is composed of a tray member shaped so that sheets of a size, preset in accordance with apparatus specifications, can be placed on the tray 15. Side guides 17 are disposed on the sheet feeding tray 15 so that the side edges of sheets can be aligned with the side guides 17. A gate stopper 60 is disposed at a leading end of the tray so that a leading end of the sheet can be abutted against and aligned with the gate stopper 60. The gate stopper 60 can be projected from and retracted onto the sheet feeding tray 15. The illustrated sheet feeding tray 15 is attached to a device frame so as to incline at a predetermined angle. The placement tray 15 can pivot around a supporting point at its leading end, shown at 15*a* in the figure.

The sheet feeding section 11 is composed of a delivery roller 18, a sheet feeding roller 19, a registration roller pair 21, and a sheet feeding path 25. A sheet is separated from the others on the sheet feeding tray 15, registered, and then fed to the first platen 2. The delivery roller 18 is located on the sheet feeding tray 15 so as to be able to elevate and lower freely. Separating means 20 such as a separating pad or a separating roller is located in pressure contact with the sheet feeding roller 19. The arrangement of the sheet feeding roller will be described below.

The sheet feeding roller 19 is located at a position corresponding to the center of sheets because the sheets that are set on the sheet feeding tray 15 and the sheet feeding tray 15 itself, are centered. The registration roller pair 21 is located downstream of the sheet feeding roller 19. The registration roller pair 21 is composed of a pair of rollers 21*a* and 21*b* that are in pressure contact with each other. One of the rollers 21*a* and 21*b* is coupled to a driving motor. Although described below, the conveying-direction length between the sheet feeding roller 19 and the registration roller pair 21 is set shorter than the conveying-direction length of the minimum size sheet.

A U-shaped conveying path is provided between the sheet feeding tray 15 and the sheet discharging tray 16 and is composed of a sheet feeding path 25 along which a sheet is conveyed from the sheet feeding tray 15 to the first platen 2. Also included is a carry-out path 26 along which the sheet is carried out from the first platen 2, and a sheet discharging path 27 along which the sheet from the carry-out path 26 is guided to the sheet discharging tray 16. The registration roller pair 21 is located on the sheet feeding path 25. A conveying roller pair 70 is located downstream of the registration roller pair 21. A lead roller 22 is located downstream of the conveying roller pair 70.

The distance between the registration roller pair (first conveying roller pair) 21 and the conveying roller pair (second conveying roller pair) 70 is shorter than the conveying-direction length of the maximum size sheet. Overlapping conveyance sensing means 90 is located between the first and second conveying roller pairs 21 and 70 and is described in detail below.

The conveying section 12 includes a pair of lead rollers 22 disposed upstream of the first platen 2 to supply the sheet to the first platen 2 and a carry-out roller pair 23 disposed downstream of the first platen 2 to discharge the sheet from the first platen 2. The sheet is conveyed along the carry-out path 26, formed of the first platen 2 and a scooping guide 6 in the image reading apparatus and a backup guide 26*a* in the ADF 10.

The sheet discharging section 13 and the switchback section 14 each include a partly shared path. The sheet discharging section 13 and the switchback section 14 have a sheet discharging roller pair 24 that discharges the sheet to the sheet discharging tray 16. The sheet discharging roller pair 24 is controllably rotated backward while nipping a trailing end of the sheet, in order to switch back and feed the sheet to the sheet feeding section 11.

A sheet discharging roller 24*b* (second sheet discharging roller) of the sheet discharging roller pair 24 is separate from a sheet discharging roller 24*a* (first sheet discharging roller) of the pair 24, so that the sheet, circulated from the switchback section 14 via the circulating path 30 and conveying section 12, can be smoothly conveyed when its leading and trailing ends pass by the roller pair 24.

An area shared by the sheet discharging section 13 and the switchback section 14 has a switchback path 28 and a flapper 29 that guides the sheet to the sheet discharging section 13. The flapper 29 is always urged by an urging spring. When the sheet is fed, along the sheet discharging path 27 (via a sheet discharging port 31 located where the sheet discharging path 27 merges with the switchback path 28), to the sheet discharging roller pair 24, the flapper 29 is pushed upward by the leading end of the sheet being discharged. This allows the sheet to pass. When the sheet discharging roller pair 24 switches back the sheet, the flapper 29 is lowered to close the sheet discharging path 27 in order to guide the sheet to the switchback path 28.

The circulating path 30 is connected to the switchback path 28 and is configured to guide the sheet, having its conveying direction reversed through the switchback path 28, to the registration roller pair 21, described above. A switchback upper guide 28*a* and a switchback lower guide 28*b*, which continue into the switchback path 28, guide the sheet to a sheet feeding position (hereinafter referred to as a "nip point") of the registration roller pair 21. That is, the circulating path 30 and the sheet feeding path 25 merge together at the nip point of the registration roller pair 21. A Myler 28*c* is extended from the merging position to guide the sheet into the nip point of the registration roller pair 21.

Figure 4:
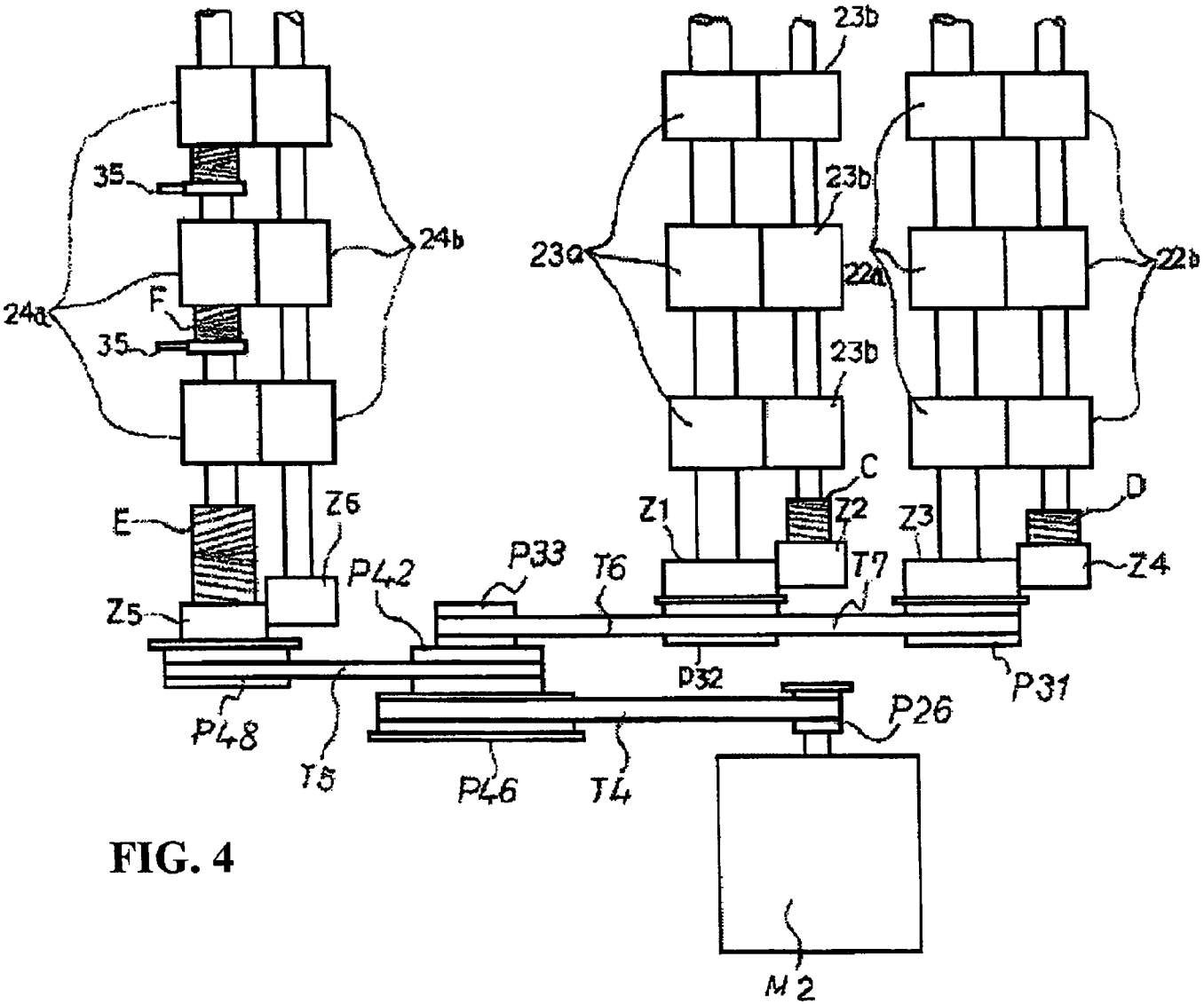
FIG. 4 is a diagram illustrating a conveyance driving mechanism in the sheet conveying device shown in FIG. 1.

Now, with reference to FIGS. 3 and 4, description will be given of a driving mechanism for the conveying rollers located on the respective paths. The ADF 10 is configured so that a sheet feeding motor M1 and a conveying motor M2 that can rotate forward and backward drive the respective conveying rollers. FIG. 3 shows a transmission mechanism for the sheet feeding motor M1. FIG. 4 shows a transmission mechanism for the conveying motor M2.

The sheet feeding motor M1 transmits a driving force to the delivery roller 18, the sheet feeding roller 19, the driving roller 21*a* of the registration roller pair 21, and the conveying roller 70*a*. The sheet feeding motor M1, which can rotate forward and backward, transmits a driving force from a pulley P16 to a pulley P36 via a timing belt T16. A driving force from the pulley P36 is transmitted to gears Z17, Z19, and Z18. A driving shaft 19*a* of the sheet feeding roller 19 is coupled to the gear Z18. This transmission system rotates the sheet feeding roller in a sheet feeding direction.

Further, a pulley P18 is provided on the driving shaft 19*a* to transmit a driving force in the sheet feeding direction to the delivery roller 18 via a timing belt T2 extended between the pulley P18 and a pulley P11 provided on a shaft of the delivery roller 18. Furthermore, one end of an elevating and lowering arm 18*a* that supports the delivery roller 18 is attached to the driving shaft 19*a* of the sheet feeding roller 19 via spring clutches A and B. Forward rotation (clockwise in FIG. 3) of the sheet feeding motor M1 rotates the driving shaft 19*a* in the sheet feeding direction. At this time the elevating and lowering arm 18*a* lowers onto the sheet feeding tray 15 through the action of the spring clutches A and B.

On the other hand, the driving roller 21*a* of the registration roller pair 21 is coupled to the sheet feeding motor M1 via a timing belt T3 extended around a pulley P28 and a pulley P22 that is coaxial with the pulley P 36. Pulley P28 is provided on a driving shaft 21*c* of the driving roller 21*a*. Backward rotation of the sheet feeding motor M1 is transmitted to the driving roller 21*a* by a one-way clutch OW1. The driving force of the sheet feeding motor M1 is also transmitted to the conveying roller pair 70 by the one-way clutch OW1 only when the motor M1 rotates backward.

An illustrated spring clutch C serves as a torque limiter that runs idly after transmitting backward rotation of the sheet feeding motor M1 to the elevating and lowering arm 18*a*, which thus swings upward from the sheet feeding tray 15. Thus, forward rotation of the sheet feeding motor M1 drivingly rotates the delivery roller 18 and the sheet feeding roller 19. This in turn lowers the delivery roller 18 from its standby position above the sheet feeding tray 15 to a position where the roller 18 comes into contact with the sheets on the sheet feeding tray 15. Backward rotation of the sheet feeding motor M1 also drivingly rotates the driving roller 21*a* of the registration roller pair 21 and the driving roller 70*a* of the conveying roller 70. This in turn moves the delivery roller 18 to its standby position above the sheet feeding tray 15.

As shown in FIG. 4, a driving force transmitting system for the conveying motor M2 transmits a driving force, from a pulley P26 provided on a driving shaft of the conveying motor M2, to a pulley P46 via a timing belt T4. The driving force is further transmitted, via a timing belt T6, from a pulley P33 that is coaxial with the pulley P46 to a pulley P32 to a shaft of a driving roller 23*a* of the carry-out roller pair 23. As a result, the driving roller 23*a* is rotated forward or backward.

The driving force transmitted to the pulley P32 is further transmitted from a gear Z1 that is coaxial with the pulley P32 to a gear Z2, to rotate a driven roller 23*b* via a spring clutch C. The peripheral speed of the driving roller 23*a* is the same as the set peripheral speed of the driven roller 23*b*. The spring clutch C absorbs a possible difference in peripheral speed between the driving roller 23*a* and the driven roller 23*b*.

Moreover, the driving force transmitted to the pulley P32 is transmitted via a timing belt T7 to a pulley P31 attached to a shaft of a driving roller 22*a* of the lead roller pair 22. The driving roller 22*a* is thus rotated forward or backward. Further, the driving force transmitted to the pulley P31 is transmitted to a gear Z4 via a gear Z3, coaxial with the pulley P31, in order to rotate a driven roller 22*b* of the lead roller pair 22 via a spring clutch D. The peripheral speed of the driving roller 22*a* is the same as the set peripheral speed of the driven roller 22*b*. The spring clutch D absorbs a possible difference in peripheral speed between the driving roller 22*a* and the driven roller 22*b*.

The driving force of the conveying motor M2 transmitted to a pulley P46 via a timing belt T4 is transmitted from a pulley P42, that is coaxial with pulley P46, to a pulley P48 via a timing belt T5. This rotates a driving roller 24*a* (first sheet discharging roller) forward or backward via a spring clutch E which is attached to a shaft of a driving roller 24*a* of the sheet discharging roller pair 24. The driving force transmitted to the pulley P48 is transmitted to a gear Z6 via a gear Z5 that is coaxial with the pulley P48, in order to rotate a driven roller 24*b* (second sheet discharging roller).

The peripheral speed of the driving roller 23*a* of the carry-out roller pair 23 is the same as the set peripheral speed of the driven roller 24*b* of the sheet discharging roller 24. The set peripheral speed of the first sheet discharging roller 24*a* is higher than that of the second sheet discharging roller 24*b*. When one sheet is nipped by the sheet discharging roller pair 24 or no sheet is present, a spring clutch E allows the first sheet discharging roller 24*a* to follow the peripheral speed of the second sheet discharging roller 24*b*.

The device has an electromagnetic solenoid (not shown) that serves as a driving source to separate the paired sheet discharging rollers 24 from each other. Exciting (turning on) the electromagnetic solenoid moves the second sheet discharging roller 24*b* to a position where it comes into pressure contact with the first sheet discharging roller 24*a*.

De-energizing (turning off) the electromagnetic solenoid moves the second sheet discharging roller 24*b* away from the first sheet discharging roller 24*a* through the action of an urging spring that urges the second sheet discharging roller 24*b* away from the first sheet discharging roller 24*a*. An anti-return lever 35 is coaxially provided on the first sheet discharging roller 24*a*, via a spring clutch F.

The sheet feeding tray 15 has a plurality of sensors S1, S2, and S3 (FIG. 1) arranged in the sheet feeding direction. The length of sheets placed on the sheet feeding tray 15 is detected on the basis of the ON or OFF state of the plurality of sensors S1, S2, and S3. Further, the width direction of the sheets placed on the sheet feeding tray 15 is detected using side guides 17, the output of which varies depending on the movement of the side guides 17. Sheet size is determined on the basis of the detected sheet width and a sheet length detected via the plurality of sensors S1, S2, and S3.

The sheet feeding tray 15 has an empty sensor S4 that detects the presence or absence of a sheet. The sheet feeding path 25 has a registration sensor S5 that detects the ends of a sheet. A lead sensor S6 is provided upstream of the first platen 2. A sheet discharging sensor S7 detects the ends of a sheet discharged from the first platen 2. Sensors S1 to S7 are connected to a CPU that drivingly controls the whole device. On the basis of detection signals from the sensors, the driving motors M1 and M2 are driven and the electromagnetic solenoid, described below, is excited.

Figure 5:
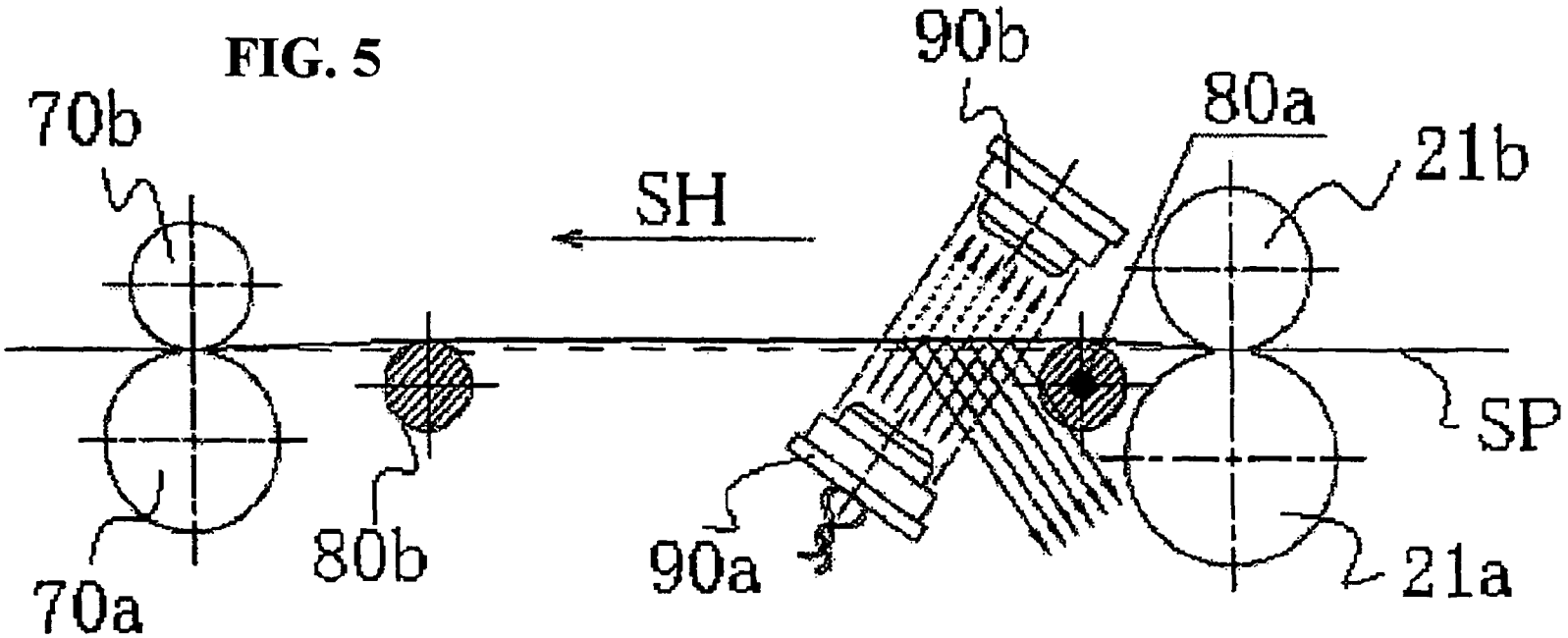
FIG. 5 is a side view of a sheet overlapping sensing device in the sheet conveying device shown in FIG. 1.
Figure 6:
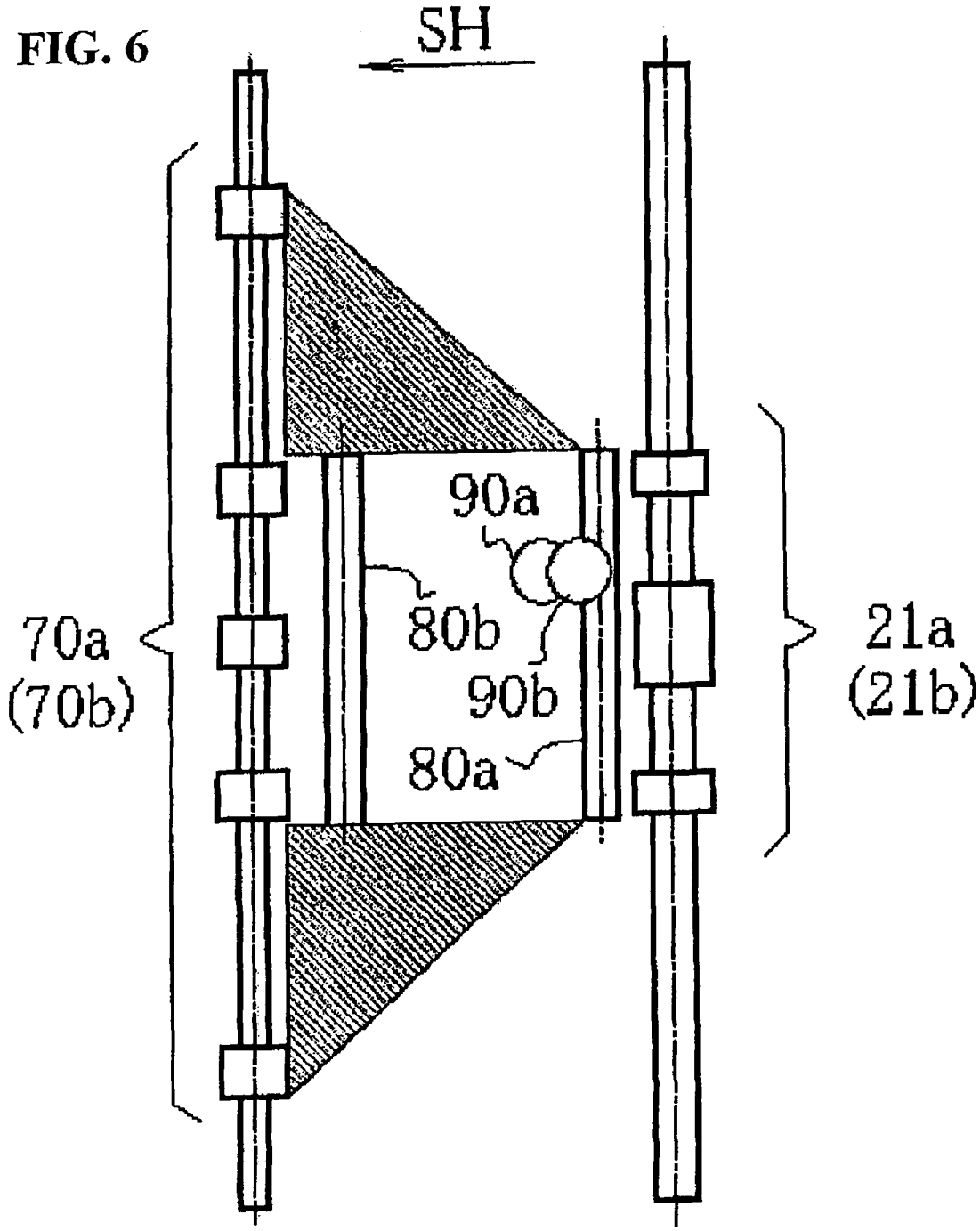
FIG. 6 is a plan view of the sheet overlapping sensing device in the sheet conveying device shown in FIG. 1.

Now, the overlapping conveyance sensing means will be described. As shown in FIGS. 5 and 6, a sheet is conveyed by the registration roller pair 21 and the conveying roller pair 70. The registration roller pair 21, positioned upstream, constitutes a first conveying roller pair, and the conveying roller pair 70 constitutes a second conveying roller pair. The distance between the registration roller pair 21 and the conveying roller pair 70 is shorter than the sheet length in the conveying direction. The first and second conveying roller pairs are composed of, for example, rubber or resin rollers lined with a gum agent in order to apply a conveying force to the sheet.

Figure 7:
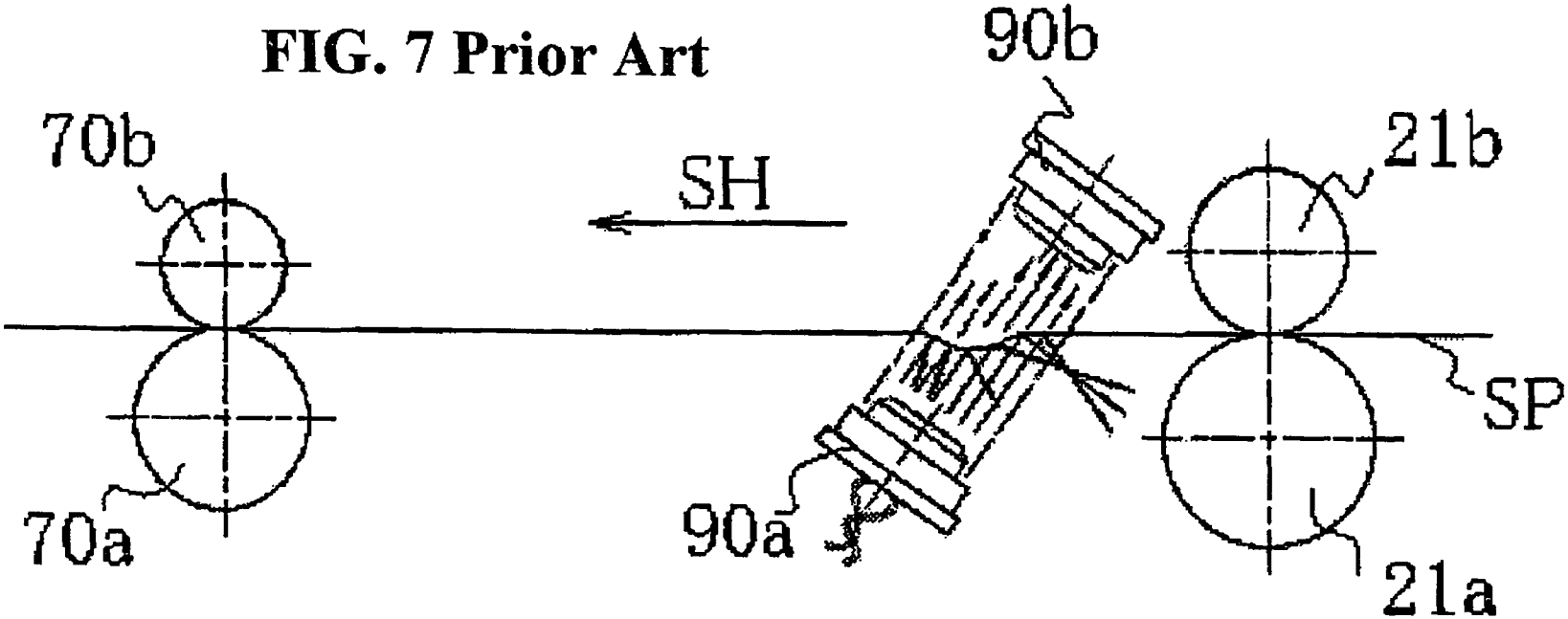
FIG. 7 Prior Art
FIG. 7 is a side view of a sheet overlapping sensing structure in a conventional sheet conveying device.
Figure 8:
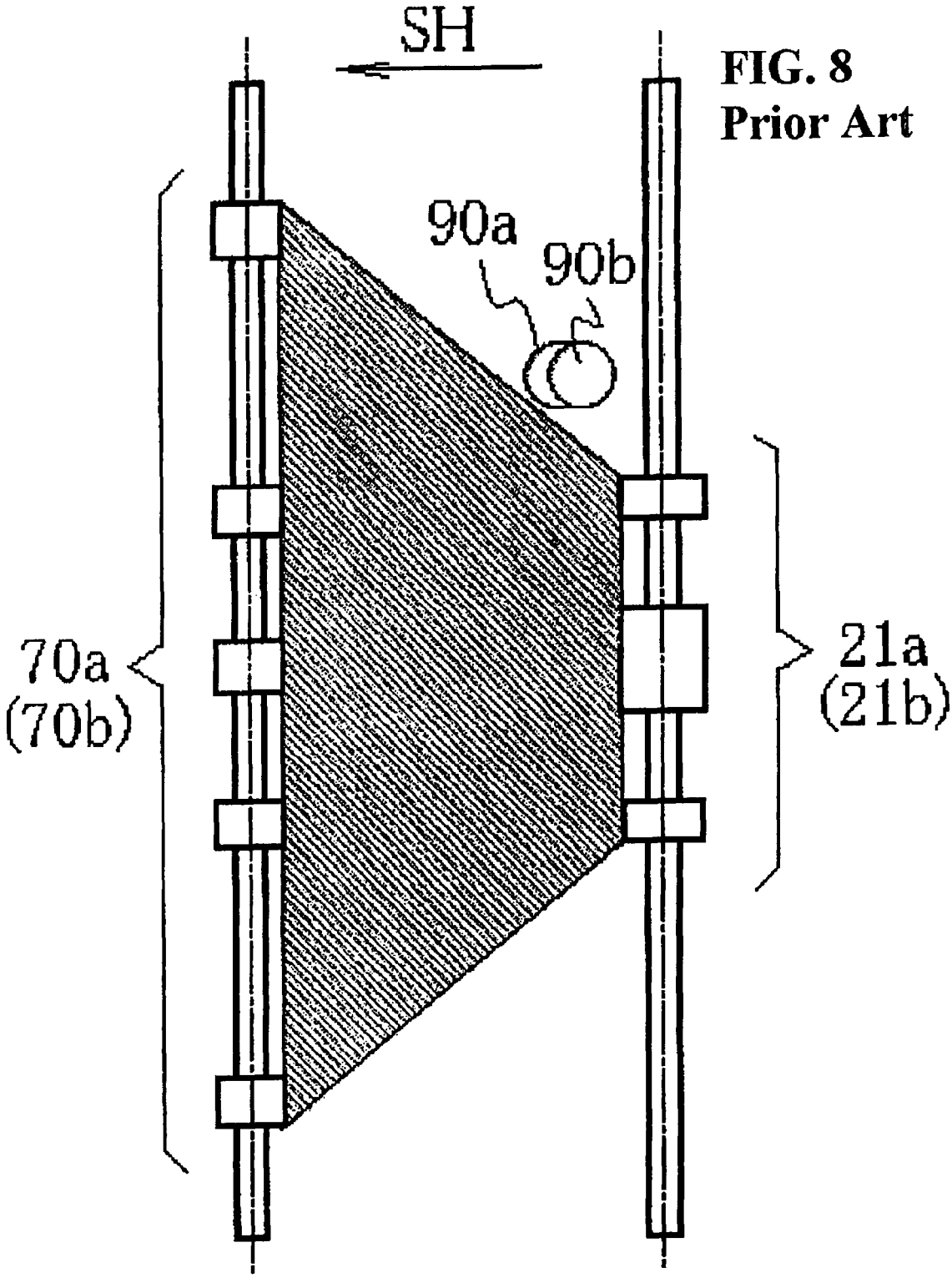
FIG. 8 Prior Art
FIG. 8 is a plan view of a sheet overlapping sensing structure in a conventional sheet conveying device.

The above sheet conveying mechanism may make the sheet wavy or locally warp the sheet during conveyance. For example, a processing or frictional dimensional difference in roller diameter may cause the sheet to be locally warped or wrinkled. Further, a variation in the load on the driving mechanism caused by a jolt or the like may make the sheet wavy during conveyance. In particular, a significant warped or wavy sheet phenomenon may occur in a shaded area in FIG. 8. Sensing overlapping conveyance during a sheet conveying process poses a problem shown in FIG. 7, as described above.

Thus, the present invention places overlapping conveyance sensing means 90, such as an ultrasonic sensor, between the first and second conveying roller pairs 21 and 70. As shown in FIG. 5, transmission means (hereinafter referred to as a transmission element) 90*a* and reception means (hereinafter referred to as a reception element) 90*b* are arranged opposite each other so as to incline at a predetermined angle. In the figure, an ultrasonic transmission element 90*a* and an ultrasonic reception element 90*b* are arranged opposite each other so as to incline, for example, at 15° to a line perpendicular to the sheet.

Guide members (or sheet guiding means that also applies to the description below) 80*a* and 80*b* are arranged on an upstream side and a downstream side, respectively, of a detection section in which an ultrasonic wave passes over the sheet. The guide members 80*a* and 80*b* are arranged, in the vicinity of the overlapping conveyance sensing means 90, to project upward or downward from a sheet conveying line (conveyance reference surface) by a predetermined amount with respect to the conveying path (a part of the sheet feeding path 25) located between the first conveying roller pair 21 and second conveying roller pair 70. The sheet conveying line (conveyance reference surface) P passes though the nips of the first and second conveying roller pairs 21 and 70. The guide members 80*a* and 80*b* may comprise lubricating guide ribs, but in the figure, they are composed of guide rollers. The guide rollers are composed of floating rollers that are rolled in conjunction with movement of the sheet.

The amount by which the guide members 80*a* and 80*b* project from the sheet conveying line SP is preferably set at an appropriate value described in the apparatus specifications for correcting the warpage of the sheet, and is, for example, experimentally set at the optimum value. Similarly, the sheet width for the guide rollers 80*a* and 80*b* is set at an appropriate value for correcting a possible warpage in the sheet in the detection section on the basis of experimental values obtained using an elongate roller (a roller structure having a cylindrical outer periphery with no steps) or the like. With this guide roller structure, even if the conveying roller pair 70 exerts a tensile force on the sheet, the guide rollers disperse the tensile force to prevent possible local warpage. Moreover, the arrangement of the guide rollers enables the overlapping conveyance sensing means 90 to be located between the conveying rollers (within the minimum size sheet) as opposed to the conventional art. Non-limiting, the conveying path (a part of the sheet feeding path 25 in FIG. 1), on which the overlapping conveyance sensing means 90 is located, is linear. In other embodiments, the conveying path may be curved.

As described above, according to the present invention, the transmission means and reception means arranged opposite each other are sandwiched between the first and second conveying roller pairs which convey the sheet. Furthermore, the guide members are provided on the upstream and downstream sides, respectively, across the transmission and reception means. The guide members are arranged so as to project upward or downward from the conveying line by the predetermined amount with respect to the conveying path, the conveying line passing through the nip points of the first and second conveying roller pairs. Consequently, a sheet moved along the conveying line formed of the first and second conveying roller pairs are pulled flat by the guide members upstream and downstream of the transmission and reception means. This allows overlapping conveyance to be accurately detected. Therefore, even when the transmission and reception means are composed of ultrasonic sensors, overlapping conveyance can be determined by passing an ultrasonic wave through the flatly pulled sheet in the direction of a predetermined angle to accurately detect the attenuation of the ultrasonic wave.

When the guide members are composed of guide rollers that rotate in conjunction with movement of the sheet, the guide rollers may have any length across the sheet width. The guide rollers can thus be located at preferable positions corresponding to the width-wise center of the sheet or to the sheet size. Consequently, when sheets of various sizes are conveyed, overlapping conveyance can be reliably detected.

The present invention exerts significant effects. In particular, when sheets on a stacker are separably fed, if ultrasonic sensors are arranged on a sheet feeding path on which the sheet leading end is registered, overlapping conveyance can be accurately detected using a simple structure.

The disclosure of Japanese Patent Application No. 2006-107499 filed on Apr. 4, 2006 is incorporated as a reference in its entirety.

While the invention has been explained with reference to the specific embodiments of the invention, the explanation is illustrative and the invention is limited only by the appended claims.

What is claimed is:

1. A sheet conveying device, comprising:

a first conveying roller pair for transferring a sheet, a second conveying roller pair for transferring the sheet, said second conveying roller pair being arranged on a downstream side of the first conveying roller pair in a sheet transferring direction at a predetermined distance away therefrom, a substantially linear conveying path for guiding the sheet from the first conveying roller pair to the second conveying roller pair, first and second guide rollers spaced apart from each other in the sheet transferring direction and disposed between the first and second conveyer roller pairs, said first and second guide rollers being located on one side relative to a straight line extending between nip points of the first and second conveying roller pairs, and projecting partly to the other side beyond the straight line so that the first and second guide rollers rotate by the sheet contacting thereto, and an ultrasonic sensing device for sensing overlapping sheets transferred in the conveying path, said ultrasonic sensing device being located between the first and second guide rollers.

2. The sheet conveying device according to claim 1, wherein said first and second guide rollers have an elongated cylindrical shape extending perpendicularly to the sheet transferring direction.

3. The sheet conveying device according to claim 1, wherein the second conveying roller pair has a transfer speed equal to or greater than that of the first conveying roller pair.

4. A sheet conveying device, comprising:

a first conveying roller pair for transferring a sheet, a second conveying roller pair for transferring the sheet, said second conveying roller pair being arranged on a downstream side of the first conveying roller pair in a sheet transferring direction at a predetermined distance away therefrom, a substantially linear conveying path for guiding the sheet from the first conveying roller pair to the second conveying roller pair, first and second guide rollers spaced apart from each other in the sheet transferring direction and disposed between the first and second conveyer roller pairs, said first and second guide rollers being located on one side relative to a straight line extending between nip points of the first and second conveying roller pairs, and projecting partly to the other side beyond the straight line so that the first and second guide rollers rotate by the sheet contacting thereto, and an ultrasonic sensing device for sensing overlapping sheets transferred in the conveying path, said ultrasonic sensing device being located between the first and second guide rollers, wherein said first and second guide rollers are arranged between the first and second conveyer roller pairs such that the sheet nipped between the first and second conveyer roller pairs is always stretched therebetween by the first and second guide rollers projecting beyond the straight line.

* * * * *